United States Patent [19]

Weber

[11] 4,292,886

[45] Oct. 6, 1981

[54] HYDRAULIC ACTUATOR CUSHIONING DEVICE IMPROVEMENT

[76] Inventor: William R. Weber, 4200 - 50th Ave., NE., Seattle, Wash. 98105

[21] Appl. No.: 108,490

[22] Filed: Dec. 31, 1979

[51] Int. Cl.[3] ..... F15B 15/22

[52] U.S. Cl. ..... 92/85 B; 91/452; 92/143

[58] Field of Search ..... 91/452, DIG. 2; 92/60, 92/85 B, 143

[56] References Cited

U.S. PATENT DOCUMENTS

| | | | |
|---|---|---|---|
| 3,023,739 | 3/1962 | Dickson et al. | 92/85 B X |
| 3,043,277 | 7/1962 | Carlson | 91/443 X |
| 3,963,045 | 6/1976 | Damitz | 91/DIG. 2 X |

*Primary Examiner*—Gerald A. Michalsky

[57] ABSTRACT

A hydraulic cushioning device, hereinafter called cushion device, improvement in which a spring loaded piston, with an axial orifice, is slidably installed in the expansion chamber, and when return pressure from a hydraulic actuator, hereinafter called actuator is routed to the expansion chamber, by the cushion device, the piston, responding to this pressure moves slowly compressing a spring until it hits a stop at which time the remaining fluid from the actuator must pass through the cushion device restriction thus slowing the actuator rod speed and as the actuator bottoms the cushion device will cease routing actuator fluid under pressure to the expansion chamber and will open the expansion chamber to drain at which time the spring, in the expansion chamber, will force the piston toward the starting end of the expansion chamber, hastening the emptying thereof.

1 Claim, 6 Drawing Figures

HYDRAULIC ACTUATOR CUSHIONING DEVICE IMPROVEMENT

In an existing cushion device the return pressure from the actuator is shuttled to the expansion chamber which allows rapid movement of the actuator piston being cushioned. When the expansion chamber is filled the actuator return fluid then must pass through a restriction causing the piston of the actuator to travel more slowly at the end of stroke thus providing the cushion effect required to prevent damage to the actuator or its load. When the actuator has bottomed and its return pressure has diminished, the cushion device opens the expansion chamber to drain and as soon as the expansion chamber is empty the cushion device is ready for the next stroke of the actuator. The time required to empty the expansion chamber, as mentioned above, may be excessive for operations that require rapid alternate movement of the actuator. An object of the present invention is an improvement which will allow the expansion chamber to empty quickly thus making the cushion device useful for rapid alternate strokes of the actuator.

The present invention employs a spring loaded piston installed in the expansion chamber. The piston has an orifice which is sized to let some fluid pass but at the same time subject the piston to sufficient pressure to compress the spring as the piston moves from one end of the chamber to the other. When the piston has moved to its stop, the remainder of the actuator return fluid is orificed as mentioned above. Now as the actuator bottoms the cushion device releases the pressure against the piston, of the present invention, and opens the expansion chamber to drain, allowing the spring loaded piston to hurriedly sweep all of the fluid out of the expansion chamber as it returns to its original non-pressurized position. This then lets the cushion device quickly be ready for the next stroke of the actuator.

Another object of the present invention is to further improve on the existing cushion device by allowing its use in closed hydraulic systems with pressurized return systems. In this instance the return spring in the expansion chamber would be sized to overcome the system return pressure while still being less than the pressure issuing from the actuator return.

A preferred embodiment of the present invention will be hereinafter described with reference to the accompanying drawings, given by way of example and in which:

FIG. 1 Depicts a cross section through the existing cushioning device with the present invention piston 23 and spring 25 installed in the expansion chamber 24.

The cushion device which is being improved by the present invention includes items 20,21,22,24,28 and 29 through 34. The operation of the cushioning device will be discussed further in the description of FIG. 6.

Figure 1:
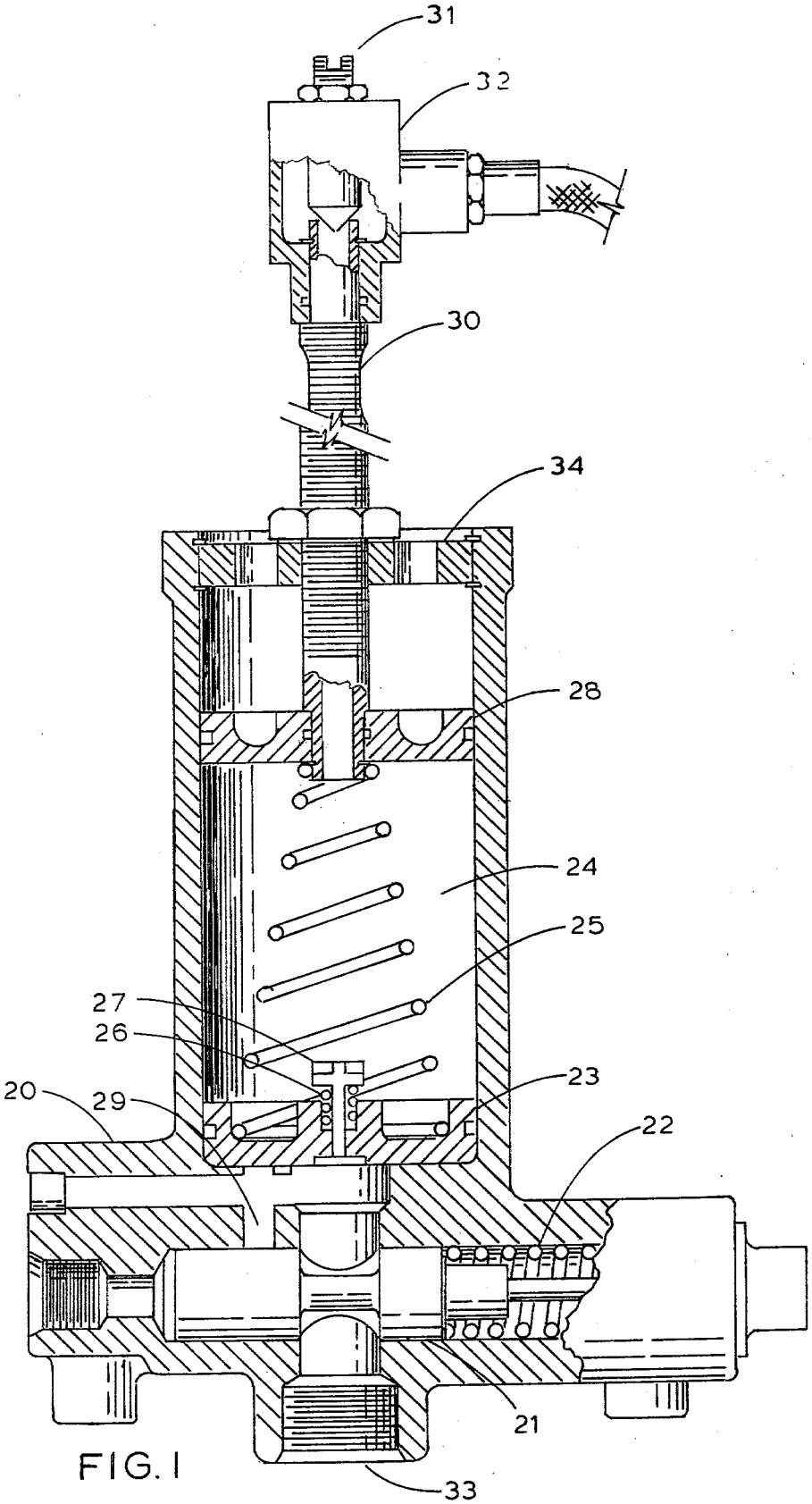
Figure 2:
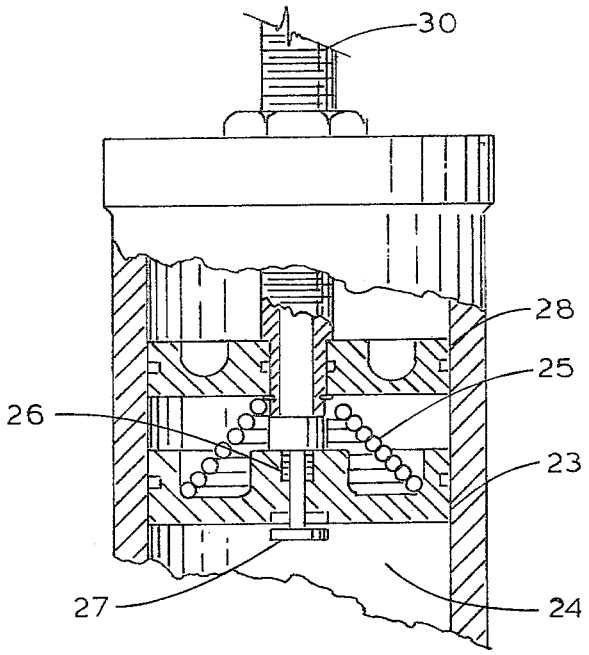
FIG. 2 Depicts a cross section through the expansion chamber of the cushion device, showing the present invention piston 23 in its pressurized position.
Figure 4:
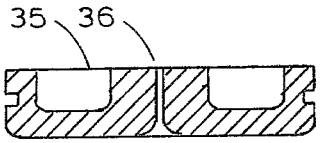
FIG. 4 Depicts a variation of the piston of the present invention.
Figure 5:
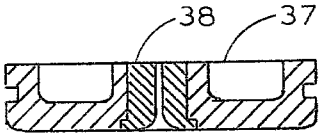
FIG. 5 Depicts a variation of the piston of the present invention.
Figure 3:
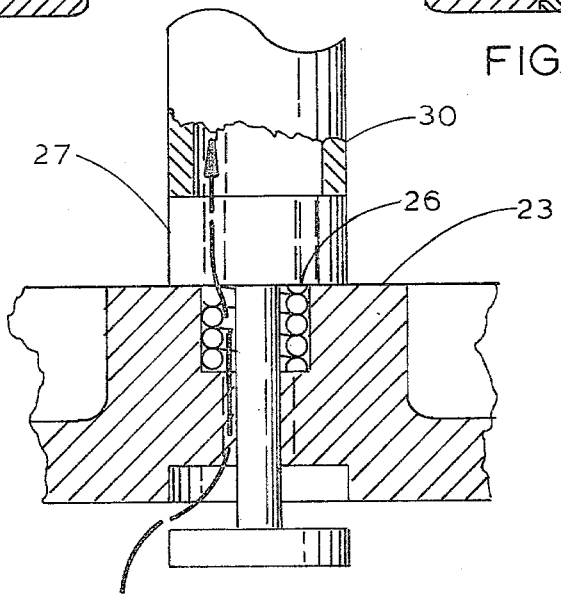
FIG. 3 Depicts the fluid flow path through the piston of the present invention in its pressurized position.
Figure 6:
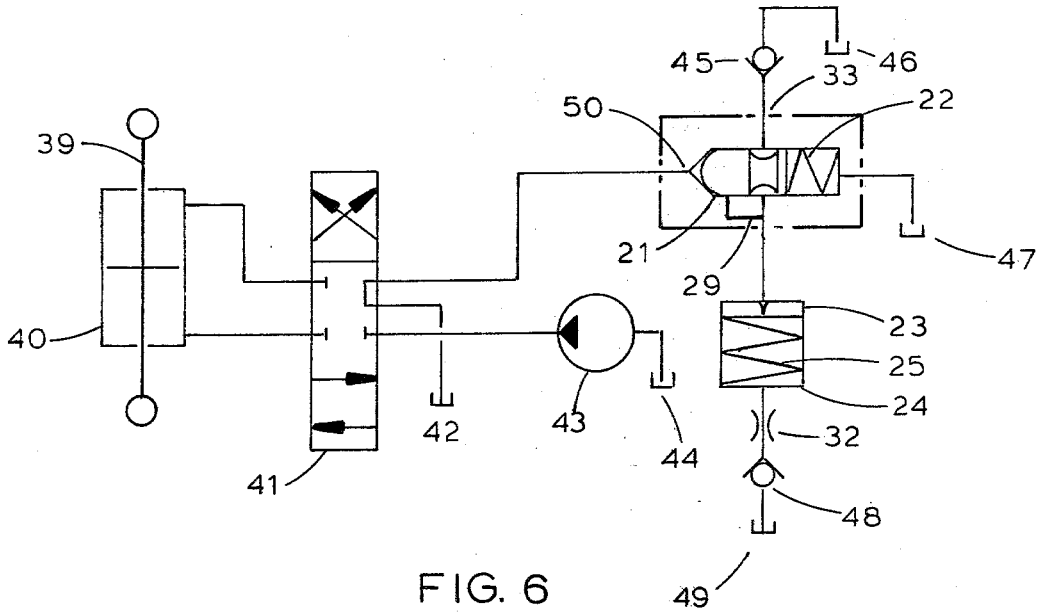
FIG. 6 Depicts a schematic of a typical hydraulic system in which the present invention could be included.

Now referring to FIG. 1, a cross section of cushion device is shown and in its expansion chamber 24 is shown a piston 23, springs 25 and 26 and a poppet valve 27. Items 23, 25 through 27 are parts of the present invention. The return pressure from the actuator 40, FIG. 6, is routed to chamber 24 through passage 29 of the cushion device. The piston 23 moves up, compressing spring 25 until poppet 27 contacts stem 30. Then the remainder of the fluid from the actuator passes through the poppet 27 through the hollow stem 30 on its way to the restriction 32. FIG. 2 shows the present invention piston 23 in its terminal position. FIG. 3 is a blowup in the area of the poppet valve 27 showing the fluid path through piston 23 and poppet 27. FIGS. 4 and 5 are variations of orifices or flow paths through piston 23 now renumbered 35 and 37. The piston 35 has a simple orifice 36 sized to match the pressure required to allow the the piston to move to its terminal position. This orifice could but doesn't necessarily have to, replace the restriction 32. The piston 37 shown in FIG. 5 is the same as piston 35 with a replaceable orifice, 38.

FIG. 6 is a schematic diagram of a hydraulic system which might use the present invention. The ultimate object is to remotely cushion hydraulic actuator 40's piston 39. The valve 41 can port fluid from the actuator 40 to either extend or retract actuator 40. When valve 41 ports fluid to the actuator, return fluid moves, under pressure, to the cushion device at inlet 50 closing port 33 and routing the fluid through passage 29 to the expansion chamber 24 forcing piston 23 to move, compression spring 25. The fluid in the actuator moves rapidly out of its return port as long as piston 23 is moving. Near the end of the actuator piston 39 stroke the piston 23 bottoms forcing all remaining actuator fluid to pass through restriction 32 to cushion the actuator piston 39 at the end of its stroke. If the valve 41 is returned to neutral the spool 21 of the cushion device moves to the left, urged by spring 22, opening the expansion chamber 24 through port 33 to drain 46. Spring 25 rapidly moves piston 23 to expel all fluid from the expansion chamber to drain 46. The cushion device is now again ready to cushion another stroke of the actuator 40.

It should be understood that modifications may be made to the cushion device improvement as above without deviating from the broader aspects thereof.

Now therefore I claim:

1. In a device for cushioning an actuator of the type wherein return fluid from the actuator passes through an expansion chamber and thence to drain through a restriction for cushioning, wherein the improvement comprises:

a. A piston with an orifice, mounted slidably in the expansion chamber, and a resilient means to bias the piston toward drain, b. A valve mounted slidably in the orifice, with resilient means to bias the valve toward the restriction, and, The valve to hold return fluid pressure on the piston face as it travels the length of the expansion chamber, until the valve bottoms allowing return fluid to pass through the orifice and then through the restriction to cushion the actuator, and said piston to return toward drain in the absence of return fluid pressure to hasten the emptying of the expansion chamber.

* * * * *